US006929702B1

(12) United States Patent
Motsenbocker

(10) Patent No.: US 6,929,702 B1
(45) Date of Patent: Aug. 16, 2005

(54) COMPOSITIONS AND METHODS FOR RELEASING ADHERENT DEPOSITS FROM SURFACES AND SUBSTRATES

(76) Inventor: Gregg Motsenbocker, P.O. Box 90947, San Diego, CA (US) 92169

( * ) Notice: Subject to any disclaimer, the term of this patent is extended or adjusted under 35 U.S.C. 154(b) by 0 days.

(21) Appl. No.: 09/678,619

(22) Filed: Oct. 2, 2000

(51) Int. Cl.[7] ..... B08B 3/00

(52) U.S. Cl. ..... 134/6; 134/40; 252/104; 252/106; 252/162; 252/170; 252/171; 252/142; 252/99; 510/411; 510/175

(58) Field of Search ..... 252/104, 106, 252/162, 171, 170, 142, 99; 510/411, 175; 134/40, 6

(56) References Cited

U.S. PATENT DOCUMENTS

| | | | | |
|---|---|---|---|---|
| 3,607,760 A | | 9/1971 | McIntyre | 252/104 |
| 3,929,662 A | * | 12/1975 | Boucher | 252/106 |
| 4,096,083 A | | 6/1978 | Clementson et al. | 252/171 |
| 4,260,510 A | * | 4/1981 | Hey et al. | 252/171 |
| 4,306,989 A | * | 12/1981 | Motsenbocker | 252/162 |
| 4,309,300 A | | 1/1982 | Danforth et al. | 252/170 |
| 4,421,665 A | * | 12/1983 | Lloyd et al. | 252/106 |
| 4,465,612 A | | 8/1984 | Altenschopfer et al. | 252/142 |
| 4,780,235 A | | 10/1988 | Jackson | 252/170 |
| 4,792,354 A | | 12/1988 | Matsuo et al. | 106/2 |
| 4,927,556 A | | 5/1990 | Pokorny | 252/173 |
| 4,934,391 A | | 6/1990 | Futch et al. | 134/40 |
| 5,084,200 A | | 1/1992 | Dishart et al. | 252/173 |
| 5,089,164 A | | 2/1992 | Stanley | 252/162 |
| 5,124,062 A | | 6/1992 | Stevens | 252/162 |
| 5,183,514 A | | 2/1993 | Marquis et al. | 134/38 |
| 5,227,085 A | | 7/1993 | Motsenbocker | 252/99 |
| 5,250,211 A | | 10/1993 | Motsenbocker | 252/99 |
| 5,415,800 A | | 5/1995 | Motsenbocker | 252/170 |
| 5,484,487 A | | 1/1996 | Motsenbocker | 134/6 |
| 5,565,511 A | | 10/1996 | Braud et al. | 524/270 |
| 5,750,488 A | * | 5/1998 | Haskell et al. | 510/412 |
| 5,817,187 A | * | 10/1998 | D'Muhala | 134/40 |
| 5,916,857 A | | 6/1999 | Watson et al. | 510/174 |
| 6,048,833 A | | 4/2000 | DeGroot | 510/412 |
| 6,059,962 A | | 5/2000 | Alexander et al. | 208/238 |
| 6,096,191 A | | 8/2000 | Kalnes | 208/105 |
| 6,342,471 B1 | * | 1/2002 | Jackson | 510/175 |

FOREIGN PATENT DOCUMENTS

| | | |
|---|---|---|
| CA | 2187552 A | 4/1998 |
| DE | 3016707 A | 11/1980 |
| DE | 4031563 A | 4/1992 |
| EP | 0625185 | 9/1998 |
| GB | 2049722 A | 12/1980 |
| WO | 9315178 | 8/1993 |
| WO | 9429392 | 12/1994 |

OTHER PUBLICATIONS

Smithsonian Magazine, Aug. 1999, Turning Water to Gold.*
Definition of non–VOC compounds.*
Methylal—NIOSH Manual of Analytical Methods, 4th Ed. Aug. 15, 1994.*
SAE Technical Paper, 1999–01–1508–Methylal and Methylal–Diesel Blended Fuels . . . May 1999.*
Loctite Technical Data Sheet Product 7063 1998.*
Tesero Petroleum Petroleum Companies Kerosene MSDS 2002.*
T.W. Brown Oil Co., Inc. Kerosense MSDS Jan. 1999.*
http://www.inchem.org/documents/icsc/icsc/eics1379.htm.*
"Determination of Volatile Organic Compound Leaks," Method 21 in 40 CFR (Code of Federal Regulations) EPA (Environmental Protection Agency) Appendix A to Part 60. A. (Jul. 1, 1999 Edition).
"National Volatile Organic Compound Emission Standards for Consumer and Commerical Products," Part. 59 of 40 CFR (Code Federal Regualations) Chapter 1 (Jul. 1, 1999 Edition).
"Organic compounds that have been exempted from EPA's definition of a Volatile Organic Compound in 40 CFR 51.100" Appendix D, EPA Small Entity Complience Guide, Jul. 1999.
"Successful Use of Aerosil Fumed Silica in Liquid Systems," News–AEROSIL. (Sep. 22, 2000).
"What is d–Limonene?," Florida Chemical Company, Inc. 2000. http://www.floridachemical.com/whatisd–limonene.htm (Aug. 24, 2000).
Calumet 400–500 Certificate of Analysis, by the Calument Lubricants Co. Laboratory Jun. 9, 2000 and accompanying Material Saftey Data Sheet.(Nov. 14, 1997).
Glycol Ethers for Cleaners. Dow Chemical Company. Available at website http://www.dow.com/.
Gustafson, R. "d–Limonene as a VOC," Florida Chemical Company, Inc. 2000. http://www.floridachemical.com/VO-Cargument.htm (Aug. 24. 2000).
Methocel J12–MS, technical specifications. Dow Chemical Company. Jun. 1997. Ingredient used in MLO #4 (aerosol). Similar information available at: http://www.dow.com/methocel/.
Motsenbockers's Lift Off #2 (non–aerosol), Material Safety Data Sheet www.liftoffinc.com/upload/products/msds/msds_2_a.htm (Nov. 9, 2000).

(Continued)

*Primary Examiner*—Sharidan Carrillo
(74) *Attorney, Agent, or Firm*—Steven W. Webb

(57) ABSTRACT

Compositions and methods for release of adherent deposits from surfaces and substrates are provided. The compositions are low volatile organic compound (low VOC) compositions, solutions or mixtures. Adherent deposits removed using the compositions include grease and oil, shoe polish, crayons, candle wax, gum, lipstick, stickers, adhesives, tape and others. The compositions may be used on any surface or substrate including carpet, fabrics, metals, painted surfaces (oil and latex), wallpapers and plastics, without harming the surface or substrate.

2 Claims, No Drawings

OTHER PUBLICATIONS

Motsenbockers's Lift Off #1, Material Safety Data Sheet, www.liftoffinc.com/upload/products/msds/msds_1.htm (Nov. 9, 2000).
Motsenbockers's Lift Off #2 (aerosol), Material Safety Data Sheet www.liftoffinc.com/upload/products/msds/msds_2.htm (Nov. 9, 2000).
Motsenbockers's Lift Off #3, Material Safety Data Sheet www.liftoffinc.com/upload/products/msds/msds_3.htm (Nov. 9, 2000).
Motsenbockers's Lift Off #5, Material Safety Data Sheet www.liftoffinc.com/upload/products/msds/msds_5.htm (Nov. 9, 2000).
Motsenbockers's Lift Off #4, Material Safety Data Sheet www.liftoffinc.com/upload/products/msds/msds_4.htm (Nov. 9, 2000).
Motsenbockers's Lift Off #1—#5 product description available on the LiftOff Inc, WEB site; at http://www.liftoff.com (Nov. 9, 2000).

Surfactants: The Theory Behind Soap., http://www/geocities.com/CapeCanaveral/3521/page1.htm (Sep. 22, 2000).

Zdankiewicz E.M., "Choosing Detection Devices for VOC Leak Testing", Pollution Engineering (Online Magazine available at; http://www.pollutionengineering.com), Jul. 1998.

Database Derwent, WPI Acc No.: 89–97196, citing German patent 4031563, "Cleaning optical components using non–halogenated solvents—by passing through successive baths contg. organic solvent, water contg. surfactant, and organic solvent for drying".

International Search Report, mailed Jan. 31, 2002, for International Patent Application PCT/US01/31005.

* cited by examiner

COMPOSITIONS AND METHODS FOR RELEASING ADHERENT DEPOSITS FROM SURFACES AND SUBSTRATES

FIELD OF THE INVENTION

The field of invention relates to compositions and methods for releasing adherent deposits from surfaces and substrates. In particular, low volatile organic compound (low VOC) compositions are provided.

BACKGROUND OF THE INVENTION

The release of adherent deposits from surfaces and substrates without damaging the surface or substrate is a continuing problem. Many of the presently used solvent and water based compositions and methods are not suitable because they cause damage to surfaces and substrates. For example, some solvent based compositions and methods cause polystyrene plastics to be permanently fogged.

Currently available compositions and methods suffer from a limited range of applicability and effectiveness, in that they remove only certain types of adherent deposits from particular surfaces and substrates.

Of particular importance herein, these solvent and water based compositions and methods for removing adherent deposits from surfaces and substrates do not meet announced governmental regulations with respect to the percentage of volatile organic compounds (VOCs) present in the composition.

Therefore, it is an object herein to provide low VOC compositions and methods for removing adherent deposits from surfaces and substrates that are effective for removing a variety of adherent deposits and are widely applicable for all surfaces and substrates.

SUMMARY OF THE INVENTION

Provided herein are compositions and methods for releasing adherent deposits from surfaces and substrates. These compositions and methods are as effective or are more effective while working in approximately the same reactionary time as those compositions and methods currently available. Further, the compositions and methods provided herein are safe for both the individual, the substrate or surface from which the adherent deposit is to be removed, and the environment.

Certain compositions provided herein contain an exempt volatile organic compound (exempt VOC) or a non-volatile organic compound (non-VOC) that is able to remove adherent deposits from surfaces and substrates.

Other compositions contain a first solvent that is able to remove adherent deposits from surfaces and substrates, and a carrier solvent, which is an exempt VOC or a non-VOC. In these compositions, the first solvent is from about 0.1% to about 50.0 weight % and the exempt VOC or non-VOC carrier solvent is from about 50.0% to about 99.9 weight %.

Other compositions provided herein contain a first solvent that is able to remove adherent deposits from surfaces and substrates, a carrier solvent, which is an exempt VOC or a non-VOC, and at least one additive. In these compositions, the first solvent is from about 0.1% to about 50.0 weight %, the exempt VOC or non-VOC carrier solvent is from about 10.0% to about 99.9 weight %, and each additive is from 0% to about 20 weight %. Additives for use in the compositions and methods provided herein include, but are not limited to, second solvents, cleaners, surfactants, coupling agents, fragrances and thickeners.

In particular, the compositions provided herein contain a first solvent that is an acetal, ketal or ortho ester. For example, in certain compositions, the first solvent is methylal.

In these compositions, the carrier solvent is a petroleum distillate, in particular, Light Hydrotreated Petroleum Distillates. In other compositions, the carrier solvent is water or is a mixture of a Light Hydrotreated Petroleum Distillates and water.

In these compositions, the first solvent is from about 0.1% to about 50.0 weight %; the carrier solvent is from about 10.0% to about 99.9 weight %; and at least one additive is selected from among a second solvent from about 0% to about 20.0 weight %; a cleaner from about 0% to about 20.0 weight %; a surfactant from about 0% to about 20.0 weight %; a coupling agent from about 0% to about 20.0 weight %; a fragrance from about 0% to about 20.0 weight %.

Certain compositions provided herein contain a first solvent that is methylal; a carrier solvent that is a Light Hydrotreated Petroleum Distillates; and, at least one additive that is a second solvent, a cleaner, a surfactant, a coupling agent, a fragrance or a thickener.

In these compositions, the first solvent is from about 0.1% to about 50.0 weight % methylal; the carrier solvent is from about 10.0% to about 99.9 weight % Light Hydrotreated Petroleum Distillates; the cleaner is from about 0% to about 20.0 weight % ethanol; and, the fragrance is from about 0% to about 20.0 weight %.

In particular, these compositions contain a first solvent that is 6.2% methylal; a carrier solvent that is 92.0% Light Hydrotreated Petroleum Distillates; a cleaner that is 0.8% ethanol; and, a fragrance that is 1.0%.

Other compositions contain a first solvent that is methylal; a carrier solvent that is a Light Hydrotreated Petroleum Distillates; and, at least one additive that is a second solvent, a surfactant or a fragrance.

In these compositions, the first solvent is from about 0.1% to about 50.0 weight % methylal; the carrier solvent is from about 10.0% to about 99.9 weight % Light Hydrotreated Petroleum Distillates; the second solvent is from about 0% to about 50.0 weight % n-propyl bromide; the surfactant is from about 0% to about 20.0 weight % TRITON® X-100 (polyethylene glycol mono(4-(1,1,3,3-tetramethylbutyl) phenyl)ether (also known as t-octylphenoxypolyethoxyethanol or polyoxyethylene (10) isooctylphenyl ether) or TRITON® XL-80N($C_8$–$C_{10}$-alkyloxypolyethyleneoxypolypropyleneoxyethanol); and, the fragrance is from about 0% to about 20.0 weight %.

In particular, these compositions contain a first solvent that is 2.0% methylal; a carrier solvent that is 84.0% Light Hydrotreated Petroleum Distillates; a second solvent that is 8.0% n-propyl bromide; a surfactant that is 5.0% TRITON® X-100 (polyoxyethylene (10) isooctylphenyl ether); and, a fragrance that is 1.0%.

Other compositions contain a first solvent that is methylal; a carrier solvent that is water; and, at least one additive that is selected from among second solvents, cleaners, surfactants, coupling agents and fragrances.

In these compositions, the first solvent is from about 0.1% to about 50.0 weight % methylal; the carrier solvent is from about 10.0% to about 99.9 weight % water; the cleaner is from about 0% to about 20.0 weight % ethanol; the surfactant is from about 0% to about 20.0 weight % TRITON® X-100 (polyoxyethylene (10) isooctylphenyl ether); the coupling agent is from about 0% to about 20.0 weight %

BUTYL CELLOSOLVE® (2-butoxyethanol); and, the fragrance is from about 0% to about 20.0 weight %.

In particular, these compositions contain a first solvent that is 11.9 weight % methylal; a carrier solvent that is 71.3 weight % water; a cleaner that is 0.8 weight % ethanol; a surfactant that is 2.7 weight % TRITON® X-100 (polyoxyethylene (10) isooctylphenyl ether); a coupling agent that is 11.9 weight % BUTYL CELLOSOLVE® (2-butoxyethanol); and, a fragrance that is 1.0 weight %.

Certain of these compositions contain less than or equal to 50 weight % VOCs. Others contain less than or equal to 40 weight % VOCs. Others, less than or equal to 35 weight % VOCs. Others, less than or equal to 25 weight % VOCs. Others, less than or equal to 22 weight % VOCs. Others, less than or equal to 10 weight % VOCs. Others, less than or equal to 7 weight % VOCs. Others, less than or equal to 5 weight % VOCs. Others, less than or equal to 4 weight % VOCs. Others, less than or equal to 3 weight % VOCs.

The methods provided allow for the release of adherent deposits from surfaces and substrates by applying an exempt VOC or a non-VOC to the deposits and then removing the released deposits from the surface or substrate. Here, the exempt VOC or non-VOC is Light Hydrotreated Petroleum Distillates. The released deposits are physically removed by either a wiping or by directing a stream of water against the released deposits.

DETAILED DESCRIPTION OF THE EMBODIMENTS

A. Definitions

Unless defined otherwise, all technical and scientific terms used herein have the same meaning as is commonly understood by one of skill in the art to which this invention belongs. All patents, patent applications and publications referred to herein are incorporated by reference in their entirety. In the event that there are a plurality of definitions for a term herein, those in this section prevail.

As used herein, additive means a substance added to another in relatively small amounts to effect a desired change in properties.

As used herein, adherent deposit means deposits that are attached to a surface or substrate.

As used herein, aerosol means a suspension of liquid particles dispensed from a pressurized container.

As used herein, adhesive means any chemical substance that is applied for the purpose of bonding two surfaces or substrates together other than by mechanical means.

As used herein, non-aerosol means a spray of liquid particles dissolved in a fluid dispensed from a pressurized or non-pressurized container.

As used herein, attached means connected to by adhesion forces. Adhesion forces act to hold particles to a surface or substrate and can range from very strong covalent bonds to relatively weak van der Wall's interactions.

As used herein, Belmay Lemon (also known as Lift Off #2 lemon fragrance product No. 127738-0296) or Belmay Citrul means a citrus based fragrance that is commercially available (Belmay, Inc., 200 Corporate Boulevard South, Yonkers, N.Y. 10701).

As used herein, Calumet 400-500, <1% means Light Hydrotreated Petroleum Distillates (CAS number 64742-47-8) which is a high boiling (>200° C.) solvent (chemical formula: $C_{10}$–$C_{17}$) that is commercially available from Calumet Lubricants Company, (2780 Waterfront Pkwy E. Suite 200, Indianapolis, Ind. 46214, product code 0501-00) and is a non-VOC or an exempt VOC.

As used herein, carrier solvent means a liquid used as a vehicle to transport other liquids or solids.

As used herein, cleaning is the removal of an undesired material from a surface or substrate.

As used herein, a complex stain (complex adherent deposit) means a stain that is comprised of a mixture of different types of chemicals. These chemical types include: water and proteins; paraffins and oils; inks and dyes; and others. For example: lipstick and crayons stains are composed of paraffin and various dyes; mayonnaise is composed of water, protein and natural oils (vinegar, egg yolks and olive oil).

As used herein, composition means the product of mixing various elements or ingredients.

As used herein, a consumer product is any household or institutional product (including paints, coatings and solvents), or substance, or article (including any container or packaging) held by any person, the use, consumption, storage, disposal, destruction, or decomposition of which may result in the release of a VOC.

As used herein, a coupling agent is an additive that compatibilizes a multiphase system resulting in an increase in the degree of homogeneity of the system. A coupling agent also works in combination with a surfactant to pull oil and water soluble particles from surfaces and substrates, and acts to keep the particles suspended in the cleaning solution to prevent it from being re-deposited on the cleaned surface or substrate.

As used herein, an exempt VOC or a non-VOC means those specific organic compounds that are not considered to be a VOC due to their negligible photochemical reactivity. Exempt VOCs and non-VOCs include but are not limited to: methane; ethane; methylene chloride (dichloromethane); 1,1,1-trichloroethane (methyl chloroform); methylal (1,1-dimethoxymethane or formaldehyde dimethyl acetal); 1,1,2-trichloro-1,2,2-trifluoroethane (CFC-113); trichlorofluoromethane (CFC-11); dichlorodifluoromethane (CFC-12); chlorodifluoromethane (HCFC-22); trifluoromethane (HFC-23); Light Hydrotreated Petroleum Distillates (Calumet 400-500); 1,2-dichloro-1,1,2,2-tetrafluoroethane (CFC-114); chloropentafluoroethane (CFC-115); 1,1,1-trifluoro-2,2-dichloroethane (HCFC-123); 1,1,2,2-tetrafluoroethane (HFC-134a); 1,1-dichloro-1-fluoroethane (HCFC-141b); 1-chloro-1,1-difluoroethane (HCFC-142b); 2-chloro-1,1,2,2-tetrafluoroethane (HCFC-124); n-propyl bromide (NPB); pentafluoroethane (HFC-125); 1,1,2,2-tetrafluoroethane (HFC-134); 1,1,1-trifluoroethane (HFC-134); 1,1-difluoroethane (HFC-152a); 1-bromoipropane; parachlorobenzotrifluoride (PCBTF); cyclic, branched, or linear completely methylated siloxanes; acetone, perchloroethylene (tetrachloroethylene); 3,3-dichloro-1,1,2,2-pentafluoropropane (HCFC-225ca); 1,3-dichloro-1,1,2,2,3-pentafluoropropane (HCFC-225cb); 1,1,1,2,3,4,4,5,5,5-decafluoropentane (HFC 43-10mee); difluoromethane (HFC-32); ethylfluoride (HFC-161); 1,1,1,3,3,3-hexafluoropropane (HFC-236fa); 1,1,2,2,3-pentafluoropropane (HFC-245ca); 1,1,2,3,3-pentafluoropropane (HFC-245ea); 1,1,1,2,3-pentafluoropropane (HFC-245eb); 1,1,1,3,3-pentafluoropropane (HFC-245fa); 1,1,1,2,3,3-hexafluoropropane (HFC-236ea); 1,1,2,2,3-pentafluoropropane (HFC-245ca); 1,1,2,3,3-pentafluoropropane (HFC-245ea); 1,1,1,2,3-pentafluoropropane (HFC-245eb); 1,1,1,3,3-pentafluoropropane (HFC-245fa); 1,1,1,2,3,3-hexafluoropropane (HFC-236ea); 1,1,1,3,3-pentafluorobutane (HFC-365mfc); chlorofluoromethane (HCFC-31); 1-chloro-1-fluoroethane (HCFC-151a); 1,2-dichloro-1,1,2-trifluoroethane (HCFC-123a); 1,1,1,2,2,3,3, 4,4-nonafluoro-4-methoxy-butane ($C_4F_9OCH_3$); 2-(difluoromethoxymethyl)-1,1,1,2,2,3,3,3-heptafluoropropane ($(CF_3)_2CFCF_2OCH_3$); 1-ethoxy-1,1,2,2,3,3,4,4,4-nonafluorobutane ($C_4F_9OC_2H_5$); 2-(ethoxydifluoromethyl)-1,1,2,3,3,3-heptafluoropropane ($(CF_3)_2CFCF_2OC_2H_5$); methyl acetate and perfluorocarbon compounds which fall into classes:

(i) Cyclic, branched, or linear, completely fluorinated alkanes;

(ii) Cyclic, branched or linear, completely fluorinated ethers with no saturations;

(iii) Cyclic, branched or linear, completely fluorinated tertiary amines with no unsaturations; and (iv) Sulfur containing perfluorocarbons with no unsaturations and with sulfur bonds only to carbon and fluorine.

As used herein, fragrances means a substance that gives off a sweet or pleasant odor.

As used herein, first solvent means a solvent having the ability to remove adherent deposits that is used in combination with a carrier solvent.

As used herein, high boiling petroleum distillates means those petroleum distillates whose boiling point is >200° C.

As used herein, low VOC compositions are those compositions used in consumer products which contain less than the limits for VOCs as defined for the applications and formulations in Table 1.

As used herein, methylal means dimethoxymethane or formaldehyde dimethyl acetal and has the chemical formula $CH_2(OCH_3)_2$.

As used herein, NPB means n-propyl bromide (1-bromopropane).

As used herein, neat means free from admixture or dilution: straight.

As used herein, percentages of components in a composition, such as a carrier solvent, first or second solvent, or additive, are given as weight percentages (weight %), unless otherwise specified.

As used herein, petroleum distillates means those products derived from a cracking process and include light naphtha (boiling between 10° C. and about 221° C.), heavy naphtha (boiling between 10° C. and about 249° C.), gasoline (boiling between 30° C. and about 200° C.), kerosene (boiling between 180° C. and about 300° C.), light cycle oil (boiling between 221° C. and about 345° C.), heavy cycle oil (boiling at temperatures higher than about 345° C.) and diesel fuel.

As used herein, release means to set free from.

As used herein, a solvent means a liquid substance that is capable of dissolving one or more other substances.

As used herein, second solvent means an additive that has the ability to remove adherent deposits used to supplement the first solvent.

As used herein, substrate means a physical material that is acted upon.

As used herein, surfaces means the exterior or upper boundary of an object or body.

As used herein, surfactant is a substance which changes the nature of a surface, including water surface tension.

As used herein, suspension means the state of a substance when its particles are mixed with but undissolved in a fluid.

As used herein, thickener means an additive used to afford a more viscous composition.

As used herein, TRITON® means a registered trademark to Union Carbide Corp. for surfactants.

As used herein, volatile organic compounds (VOCs) means any compound of carbon, excluding carbon monoxide, carbon dioxide, carbonic acid, metallic carbides or carbonates and ammonium carbonate, which participates in atmospheric photochemical reactions with oxides of nitrogen ($NO_x$) in the presence of sunlight to produce ozone.

For the purposes of determining compliance with emissions limits, VOC will be measured by the test methods in the approved State implementation plan (SIP) or 40 CFR part 60, Appendix A, as applicable. Where such a method also measures compounds with negligible-reactive compounds may be excluded as VOC if the amount of such compounds is accurately quantified, and such exclusion is approved by the enforcement authority.

40 CFR 60, Appendix A

Method 21-Determination of Volatile Organic Compounds Leaks

1. Applicability and Principle.

1.1. Applicability. This method applies to the determination of volatile organic compound (VOC) leaks from process equipment. These sources include, but are not limited to: valves, flanges and other connections, pumps and compressors, pressure relief devices, process drains, open-ended valves, pump and compressor seal system degassing vents, accumulator vessel vents, agitator seals, and access door seals.

1.2 Principle. A portable instrument is used to detect VOC leaks from individual sources. The instrument detector type is not specified, but it must meet the specifications and performance criteria contained in Section 3. A leak definition concentration based on a reference compound is specified in each applicable regulation. This procedure is intended to locate and classify leaks only, and is not to be used as a direct measure of mass emission rates from individual sources.

2. Definitions.

2.1 Leak Definition Concentration. The local VOC concentration at the surface of a leak source that indicates that a VOC emission (leak) is present. The leak definition is an instrument meter reading based on a reference compound.

2.2 Reference Compound. The VOC species selected as an instrument calibration basis for specification of the leak definition concentration. (For example: If a leak definition concentration is 10,000 ppmv as methane, then any source emission that results in a local concentration that yields a meter reading of 10,000 on an instrument calibrated with methane would be classified as a leak. In this example, the leak definition is 10,000 ppmv, and the reference compound is methane.)

2.3 Calibration Gas. The VOC compound used to adjust the instrument meter reading to a known value. The calibration gas is usually the reference compound at a concentration approximately equal to the leak definition concentration.

2.4 No Detectable Emission. Any VOC concentration at a potential leak source (adjusted for local VOC ambient concentration) that is less than a value corresponding to the instrument readability specification of section 3.1.1(c) indicates that a leak is not present.

2.5 Response Factor. The ratio of the known concentration of a VOC compound to the observed meter reading when measured using an instrument calibrated with the reference compound specified in the application regulation.

2.6 Calibration Precision. The degree of agreement between measurements of the same known value, expressed as the relative percentage of the average difference between the meter readings and the known concentration to the known concentration.

2.7 Response Time. The time interval from a step change in VOC concentration at the input of the sampling system to the time at which 90 percent of the corresponding final value is reached as displayed on the instrument readout meter.

3. Apparatus.

3.1 Monitoring Instrument.

3.1.1 Specifications.

a. The VOC instrument detector shall respond to the compounds being processed. Detector types which may meet this requirement include, but are not limited to: catalytic oxidation, flame ionization, infrared absorption, and photoionization.

b. Both the linear response range and the measurable range of the instrument for each of the VOC to be measured, and for the VOC calibration gas that is used for calibration, shall encompass the leak definition concentration specified in the regulation. A dilution probe assembly may be used to bring the VOC concentration within both ranges; however, the specifications for instrument response time and sample probe diameter shall still be met.

c. The scale of the instrument meter shall be readable to +/−2.5 percent of the specified leak definition concentration when performing a no detectable emission survey.

d. The instrument shall be equipped with an electrically driven pump to insure that a sample is provided to the detector at a constant flow rate. The nominal sample flow rate, as measured at the sample probe tip, shall be 0.10 to 3.0 liters per minute when the probe is fitted with a glass wool plug or filter that may be used to prevent plugging of the instrument.

e. The instrument shall be intrinsically safe as defined by the applicable U.S.A. standards (e.g., National Electric Code by the National Fire Prevention Association) for operation in any explosive atmospheres that may be encountered in its use. The instrument shall, at a minimum, be intrinsically safe for Class 1, Division 1 conditions, and Class 2, Division 1 conditions, as defined by the example Code. The instrument shall not be operated with any safety device, such as an exhaust flame arrestor, removed.

f. The instrument shall be equipped with a probe or probe extension for sampling not to exceed ¼ in. in outside diameter, with a single end opening for admission of sample.

3.1.2 Performance Criteria.

a. The instrument response factors for each of the VOC to be measured shall be less than 10. When no instrument is available that meets this specification when calibrated with the reference VOC specified in the applicable regulation, the available instrument may be calibrated with one of the VOC to be measured, or any other VOC, so long as the instrument then has a response factor of less than 10 for each of the VOC to be measured.

b. The instrument response time shall be equal to or less than 30 seconds. The instrument pump, dilution probe (if any), sample probe, and probe filter, that will be used during testing, shall all be in place during the response time determination.

c. The calibration precision must be equal to or less than 10 percent of the calibration gas value.

d. The evaluation procedure for each parameter is given in Section 4.4.

3.1.3 Performance Evaluation Requirements.

a. A response factor must be determined for each compound that is to be measured, either by testing or from reference sources. The response factor tests are required before placing the analyzer into service, but do not have to be repeated at subsequent intervals.

b. The calibration precision test must be completed prior to placing the analyzer into service, and at subsequent 3-month intervals or at the next use whichever is later.

c. The response time test is required prior to placing the instrument into service. If a modification to the sample pumping system or flow configuration is made that would change the response time, a new test is required prior to further use.

3.2 Calibration Gases. The monitoring instrument is calibrated in terms of parts per million by volume (ppmv) of the reference compound specified in the applicable regulation. The calibration gases required for monitoring and instrument performance evaluation are a zero gas (air, less than 10 ppmv VOC) and a calibration gas in air mixture approximately equal to the leak definition specified in the regulation. If cylinder calibration gas mixtures are used, they must be analyzed and certified by the manufacturer to be within +/−2 percent accuracy, and a shelf life must be specified. Cylinder standards must be either reanalyzed or replaced at the end of the specified shelf life. Alternatively calibration gases may be prepared by the user according to any accepted gaseous standards preparation procedure that will yield a mixture accurate to within +/−2 percent. Prepared standards must be replaced each day of use unless it can be demonstrated that degradation does not occur during storage.

Calibrations may be performed using a compound other than the reference compound if a conversion factor is determined for that alternative compound so that the resulting meter readings during source surveys can be converted to reference compound results.

4. Procedures.

4.1 Pretest Preparations. Perform the instrument evaluation procedures given in Section 4.4 if the evaluation requirements of Section 3.1.3 have not been met.

4.2 Calibration Procedures. Assemble and start up the VOC analyzer according to the manufacturer's instructions. After the appropriate warmup period and zero internal calibration procedure, introduce the calibration gas into the instrument sample probe. Adjust the instrument meter readout to correspond to the calibration gas value.

Note: If the meter readout cannot be adjusted to the proper value, malfunction of the analyzer is indicated and corrective actions are necessary before use.

4.3 Individual Source Surveys.

4.3.1 Type I—Leak Definition Based on Concentration. Place the probe inlet at the surface of the component interface where leakage could occur. Move the probe along the interface periphery while observing the instrument readout. If an increased meter reading is observed, slowly sample the interface where leakage is indicated until the maximum meter reading is obtained. Leave the probe inlet at this maximum reading location for approximately two times the instrument response time. If the maximum observed meter reading is greater than the leak definition in the applicable regulation, record and report the results as specified in the regulation reporting requirements. Examples of the application of this general technique to specific equipment types are:

a. Valves—The most common source of leaks from valves is at the seal between the stem and housing. Place the probe at the interface where the stem exits the packing gland and sample the stem circumference. Also, place the probe at the interface of the packing gland take-up flange seat and sample the periphery. In addition, survey valve housings of multipart assembly at the surface of all interfaces where a leak could occur.

b. Flanges and Other Connections—For welded flanges, place the probe at the outer edge of the flange-gasket interface and sample the circumference of the flange. Sample other types of nonpermanent joints (such as threaded connections) with a similar traverse.

c. Pumps and Compressors—Conduct a circumferential traverse at the outer surface of the pump or compressor shaft and seal interface. If the source is a rotating shaft, position the probe inlet within 1 cm of the shaft-seal interface for the survey. If the housing configuration prevents a complete traverse of the shaft periphery, sample all accessible portions. Sample all other joints on the pump or compressor housing where leakage could occur.

d. Pressure Relief Devices—The configuration of most pressure relief devices prevents sampling at the sealing seat interface. For those devices equipped with an enclosed extension, or horn, place the probe inlet at approximately the center of the exhaust area to the atmosphere.

e. Process Drains—For open drains, place the probe inlet at approximately the center of the area open to the atmosphere. For covered drains, place the probe at the surface of the cover interface and conduct a peripheral traverse.

f. Open-Ended Lines of Valves—Place the probe inlet at approximately the center of the opening to the atmosphere.

g. Seal System Degassing Vents and Accumulator Vents—Place the probe inlet at approximately the center of the opening to the atmosphere.

h. Access Door Seals—Place the probe inlet at the surface of the door seal interface and conduct a peripheral traverse.

4.3.2 Type II—"No Detectable Emission".

Determine the local ambient concentration around the source by moving the probe inlet randomly upwind and downwind at a distance of one to two meters from the source. If an interference exists with this determination due to a nearby emission or leak, the local ambient concentration may be determined at distances closer to the source, but in no case shall the distance be less than 25 centimeters. Then move the probe inlet to the surface of the source and determine the concentration described in 4.3.1. The difference between these concentrations determines whether there are no detectable emissions. Record and report the results as specified by the regulation.

For those cases where the regulation requires a specific device installation, or that specified vents be ducted or piped to a control device, the existence of these conditions shall be visually confirmed. When the regulation also requires that no detectable emissions exist, visual observations and sampling surveys are required. Examples of this technique are:

a. Pump or Compressor Seals-if applicable, determine the type of shaft seal. Preform a survey of the local area ambient VOC concentration and determine if detectable emissions exist as described above.

b. Seal System Degassing Vents, Accumulator Vessel Vents, Pressure Relief Devices-if applicable, observe whether or not the applicable ducting or piping exists. Also, determine if any sources exist in the ducting or piping where emissions could occur prior to the control device. If the required ducting or piping exists and there are no sources where the emissions could be vented to the atmosphere prior to the control device, then it is presumed that not detectable emissions are present. If there are sources in the ducting or piping where emission could be vented or sources where leaks could occur, the sampling surveys described in this paragraph shall be used to determine if detectable emissions exist.

4.3.3 Alternative Screening Procedure. A screening procedure based on the formation of bubbles in a soap solution that is sprayed on a potential leak source may be used for those sources that do not have continuously moving parts, that do not have surface temperatures greater than the boiling point or less than the freezing point of the soap solution, that do not have open areas to the atmosphere that the soap solution cannot bridge, or that do not exhibit evidence of liquid leakage. Sources that have these conditions present must be surveyed using the instrument techniques of 4.3.1 or 4.3.2.

Spray a soap solution over all potential leak sources. The soap solution may be a commercially available leak detection solution or may be prepared using concentrated detergent and water. A pressure sprayer or a squeeze bottle may be used to dispense the solution. Observe the potential leak sites to determine if any bubbles are formed. If no bubbles are observed, the source is presumed to have no detectable emissions or leaks as applicable. If any bubbles are observed, the instrument techniques of 4.3.1 or 4.3.2 shall be used to determine if a leak exists, or if the source has detectable emissions, as applicable.

4.4 Instrument Evaluation Procedures. At the beginning of the instrument performance evaluation test, assemble and start up the instrument according to the manufacturer's instructions for recommended warmup period and preliminary adjustments.

4.4.1 Response Factor. Calibrate the instrument with the reference compound as specified in the applicable regulation. For each organic species that is to be measured during individual source surveys, obtain or prepare a known standard in air at a concentration of approximately 80 percent of the applicable leak definition unless limited by volatility or explosivity. In these cases, prepare a standard at 90 percent of the saturation concentration, or 70 percent of the lower explosive limit, respectively. Introduce this mixture to the analyzer and record the observed meter reading. Introduce zero air until a stable reading is obtained. Make a total of there measurements by alternating between the known mixture and zero air. Calculate the response factor for each repetition and the average response factor.

Alternatively, if response factors have been published for the compounds of interest for the instrument or detector type, the response factor determination is not required, and existing results may be referenced. Examples of published response factors for flame ionization and catalytic oxidation detectors are included in Bibliography.

4.4.2 Calibration Precision. Make a total of three measurements by alternately using zero gas and the specified calibration gas. Record the meter readings. Calculate the average algebraic difference between the meter readings and the known value. Divide this average difference by the known calibration value and multiply by 100 to express the resulting calibration precision as a percentage.

4.4.3 Response Time. Introduce zero gas into the instrument sample probe. When the meter reading has stabilized, switch quickly to the specified calibration gas. Measure the time from switching to when 90 percent of the final stable reading is attained. Preform this test sequence three times and record the results. Calculate the average response time.

5. BIBLIOGRAPHY

1. DuBose, D. A., and G. E. Harris. Response Factors of VOC Analyzers at a Meter Reading of 10,000 ppmv for Selected Organic Compounds. U.S. Environmental Protection Agency, Research Triangle Park, N.C. Publication No. EPA 600/2-81-051. September 1981.

2. Brown, G. E., et al. Response Factors of VOC Analyzers Calibrated with Methane for Selected Organic Compounds. U.S. Environmental Agency, Research Triangle Park, N.C. Publication No. EPA 600/2-81-022. May 1981.
3. DuBose, D. A., et al. Response of Portable VOC Analyzers to Chemical Mixtures. U.S. Environmental Protection Agency, Research Triangle Park, N.C. Publication No. EPA 600/2-81-110. September 1981.

B. Compositions for Releasing Adherent Deposits

The compositions provided herein release a wide variety of adherent deposits from surfaces and substrates. Adherent deposits are characterized by the formation of an adherent layer which is attached to a surface or substrate. It is the purpose of these compositions to reduce or eliminate the extent of attachment, so the adherent layer can be physically removed from the surface or substrate without damage to the surface or substrate.

Compositions useful for releasing adherent deposits from surfaces and substrates contain one or more exempt VOC or non-VOCs. Other compositions include a first solvent, an exempt VOC or non-VOC carrier solvent and optionally one or more additives. The various combinations of these solvents and additives affords low VOC compositions useful for releasing adherent deposits.

(i) First Solvent

The first solvent should have good solvency for releasing adherent deposits from surfaces and substrates.

The first solvents can be aromatic hydrocarbon solvents. These aromatic hydrocarbon solvents include but are not limited to: benzene, toluene, xylenes and others.

Other first solvents are acyclic and cyclic ketones. These acyclic and cyclic etones include but are not limited to: pentanone, hexanone, cyclopentanone and cyclohexanone. Cyclohexanone is an especially useful first solvent in attacking inks and dyes.

Other first solvents are acyclic or cyclic acetals, ketals or ortho esters. These acyclic or cyclic acetals, ketals or ortho esters include but are not limited to: diethoxy methane, dipropoxy methane, dimethoxy ethane, diethoxy ethane, dipropoxy ethane, 2,2-dimethoxy propane, 2,2-diethoxy propane, 2,2-dipropoxy propane, 2,2-dimethyl-1,3-dioxalane, trimethyl orthoformate, triethyl orthoformate, trimethyl orthoacetate, triethyl orthoacetate, trimethyl orthobenzoate, triethyl orthobenzoate and others.

In an embodiment, the first solvent is methylal (dimethoxy methane). Methylal is a volatile solvent (b.p. 41–42° C.) that has the property of softening or dissolving adherent deposits bound to various surfaces and substrates to allow their release. Compositions containing from about 0.1% to about 50.0% methylal, are useful for removing adherent deposits from surfaces and substrates.

It should be noted that any of the first solvents can be used either in combination with an exempt VOC or non-VOC carrier solvents, or as a mixture of two or more first solvents in combination with an exempt VOC or non-VOC carrier solvents, or optionally other additives, to remove adherent deposits from surfaces and substrates.

(ii) Carrier Solvent

The carrier solvent should have a lesser inherent volatility than the first solvent, to reduce the volatility of the compositions. The carrier solvent should have adequate dissolving power of its own to keep the softened or suspended released deposits in solution or suspension even after most of the other solvents have evaporated to prevent the released deposits from re-adhering.

High boiling petroleum distillates of low volatility are excellent for use as the carrier solvent. Petroleum distillates in the boiling ranges from naphtha to diesel fuel can function with varying degrees of effectiveness as a carrier solvent. Petroleum distillates can be classified as being either a VOC, or as an exempt VOC or non-VOC. When used in combination with a first solvent and optionally, one or more additives, an exempt VOC or non-VOC carrier solvent can afford a low VOC composition for removing adherent deposits from surfaces and substrates.

In an embodiment, the carrier solvent is an exempt VOC or non-VOC which belongs to the chemical family known as "petroleum hydrocarbon distillate" and has the chemical name of "Light Hydrotreated Petroleum Distillates." Calumet 400-500 is the tradename for this class of petroleum distillates as sold by Calumet Lubricants. Compositions containing from about 10.0% to about 99.9% Light Hydrotreated Petroleum Distillates are useful for removing adherent deposits from surfaces and substrates.

In other embodiments, the carrier solvent is water, an exempt VOC or non-VOC. Water-based formulations may contain a first solvent and optionally one or more additives. The upper limit for a homogeneous one-phase water based formulation is a composition which contains about 55.0% water, 35.0% methylal and 10.0% of an alcoholic solvent, such as methanol, ethanol or isopropanol. Non-ionic surfactants and/or a coupling agents, can be used to emulsify water based compositions. Compositions containing from about 10.0% to about 99.9% water are useful for removing adherent deposits from surfaces and substrates.

In other embodiments, a mixture of Light Hydrotreated Petroleum Distillates and water are used as the carrier solvents. As previously mentioned, the presence of water in the compositions may require additional additives such as alcoholic solvents, surfactants and coupling agents, for optimal performance. Compositions containing from about 0.1% to about 99.9% Light Hydrotreated Petroleum Distillates and from about 0.1% up to about 99.9% water, in combination with first solvents and additives, are useful for removing adherent deposits from surfaces and substrates.

Exempt VOC or non-VOC carrier solvents can be used either neat, in combination with one or more first solvents or additives, or as a mixture of two or more carrier solvents in combination with one or more first solvents or additives, to remove adherent deposits from surfaces and substrates.

(iii) Additives

Various additives such as second solvents, cleaners, surfactants, coupling agents, odor masking fragrances and thickeners, are optionally added to the compositions. These additives, while not generally required to remove adherent deposits, are provided for optimal cleaning performance and appeal to the consumer.

(a) Second Solvent

Although very suitable results can be obtained with the use of only a first solvent in a carrier solvent, it is frequently desirable to supplement the first solvent with a second solvent. Second solvents are selected primarily for their effectiveness in softening or dissolving adherent deposits, for their low volatility and also their low flammability.

In an embodiment, a second solvent used in combination with a first solvent, carrier solvents and other additives, are the halogenated hydrocarbon solvents. These halogenated hydrocarbon solvents include but are not limited to: trichloroethylene, perchloroethylene and 1,1,1-trichloroethane (methylchloroform) and n-propyl bromide. Compositions containing from about 0% to about 50.0 weight % n-propyl bromide are useful for removing adherent deposits from surfaces and substrates.

In another embodiment, a second solvent used is 1-methyl-2-pyrrolidinone (NMP), a solvent especially useful for water miscible applications. Compositions containing from about 0% to about 50.0% NMP are useful for removing adherent deposits from surfaces and substrates.

The second solvent may be used in these compositions in combination with any of the first solvents, carrier solvents or additives or as a mixture of two or more second solvents in combination with any of the first solvents, carrier solvents or additives to remove adherent deposits from surfaces and substrates.

(b) Cleaners

A cleaner can be added in small amounts to render the removed, undissolved adherent particles non-sticky so they can be readily wiped off. Small amounts of a cleaner tend to leave a smooth clean surface after removal of the released adherent deposits. In one embodiment, the cleaner is an alcoholic solvent. These alcohols include but are not limited to: methanol, ethanol, propanol, isopropanol, butanol and others. In another embodiment, the cleaner is mineral oil. Compositions containing from about 0% to about 20.0 weight % ethanol and/or from about 0% to about 20.0 weight % mineral oil are useful for removing adherent deposits from surfaces and substrates.

(c) Surfactants

Surfactants can be added to the compositions to assist in the release of adherent deposits from surfaces and substrates by suspension and emulsification. Non-ionic surfactants are a class of surfactants that have non-ionic but polar head group (hydrophilic) and a non-polar hydrocarbon tail (hydrophobic). These head groups are usually based on a polyoxyenthylene chain. An example is polyethyleneglycol mono[4-(1,1,3,3-tetramethylbutyl)phenyl]ether (also known as t-octylphenoxypolyethoxyethanol) which is commercially available under the name of TRITON® X-100 (polyoxy-ethylene (10) isooctylphenyl ether). Other suitable non-ionic surfactants for use in these compositions include but are not limited to: polyoxyethylene ethers such as TRITON® XL-80N ($C_8$–$C_{10}$-alkyloxypolyethylene-oxypolypropylene-oxy-ethanol), TRITON® B (benzyltrimethylammonium hydroxide), TRITON® N-101 (polyoxyethylene branched nonylphenyl ether) and TRITON® X-101, reduced (polyoxyethylene (10) isooctylphenyl ether); TRITON® X-100 (polyoxyethylene (10) isooctylphenyl ether) and TRITON® X-100, reduced (polyoxyethylene (10) isooctylcyclohexyl ether); TRITON® X-114 (polyoxyethylene (8) isooctylphenyl ether) and TRITON® X-114], reduced (polyoxyethylene (8) isooctylcyclohexyl ether); TRITON® X-405 (polyoxyethylene (40) isooctylphenyl ether) and TRITON® X-405, reduced (polyoxyethylene (40) isooctylcyclohexyl ether); sorbitan esters such as sorbitan monolaurate (SPAN® 20); sorbitan monooleate (SPAN® 80); sorbitan palmitate (SPAN® 40); sorbitan monostearate SPAN® 60; sorbitan sesquitolate SPAN® 83, sorbitan trioleate SPAN® 85, also included are polyoxyethylene oleic acid ester derivatives, polyoxyethylene lauryl amine derivatives, polyoxyethylene stearyl amine derivatives, polyoxyethylene oleyl amine derivatives, polyoxyethylene castor oil derivatives, polyoxyethylene hydrogenated castor oil derivatives, polyoxyethylene bis phenol ether derivatives, polyoxyethylene glycols, sorbitan fatty acid ester derivatives, polyoxyethylene sorbitan fatty acid ester derivatives and polyoxyethylene-polyoxypropylene derivatives and others. Compositions containing from about 0% to about 20.0 weight % TRITON® X-100 (polyoxyethylene (10) isooctylphenyl ether) are useful for removing adherent deposits from surfaces and substrates.

(d) Coupling Agents

Coupling is a method of compatibilizing a multiphase system that results in an increase in the degree of homogeneity of the system (J. Culver,"Selecting Coupling Agents for Multiphase Models," Modern Paint and Coatings, October, 1980, p. 102). Glycol ethers are strong couplers, have inherent cleaning power and work in combination with surfactants to pull oil and water soluble adherent deposits from the surface or substrate. Glycol ethers also couple oil soluble deposits with water and, together with the surfactant, keep the dirt suspended in the solution to prevent it from being re-deposited on the cleaned surface or substrate. Examples of coupling agents include but are not limited to: BUTYL CELLOSOLVE® or DOWANOL® EB (2-butoxyethanol or ethylene glycol monobutyl ether), DOWANOL® PnB (propylene glycol n-butyl ether), DOWANOL® DPM (dipropylene glycol methyl ether), DOWANOL® PnB (propylene glycol n-butyl ether), DOWANOL® PM (propylene glycol methyl ether), DOWANOL® DB (diethylene glycol monobutyl ether), DOWANOL® DPnB (dipropylene glycol n-butyl ether), DOWANOL® DPB (dipropylene glycol monobutyl ether).

In an embodiment, BUTYL CELLOSOLVE® (2-butoxyethanol) or DOWANOL® EB, acts to emulsify water containing compositions and is particularly useful for removing printing inks. Compositions containing from about 0% to about 20.0 weight % BUTYL CELLOSOLVE® (2-butoxyethanol) are useful for removing adherent deposits from surfaces and substrates.

(e) Fragrances

A fragrance may be used in the compositions to make the solutions more appealing to consumers. There are many common fragrance chemicals used in commercially available laundry products and cleaners to mask odors. These fragrances include but are not limited to: alpha terpineol, agrumen aldehyde light-4, allyl cyclohexane proprionate, alpha pinene, amyl cinnamic aldehyde, amyl salicylate, Belmay Lemon, Belmay Citrus, benzoin resinoid 80% in DEP, benzyl acetate, benzyl alcohol, benzyl benzoate, benzyl salicylate, beta pinene, cedarleaf, cedarwood terpenes, cinnamic alcohol, cis-3-hexenyl tiglate, citral, citrathal, citronella, citronellol, civet artificial, clary sage-western, clove stem oil, coumarin, decyl aldehyde, diethylphthalate, dihydro myrcenol, dipropylene glycol, dodecalactone, ethylene brassylate, eucalyptol, eucalyptus, eugenol, fixateur 505, frutene, galaxolide 50%, galbanum 50%, geraniol, geranium bourbon oil, geranyl nitrile, hexyl cinnamic aldehyde, hydroxycitronellal, indol, intreleven aldehyde, ionone gamma methyl, ionone methyl, iso bornyl acetate, iso cyclo citral, iso eugenol, labdanum resin, laevo menthone, lanandin, lavender, lavol, lemon cold pressed, lemongrass, d-limonene, linalool, linalyl acetate, LRG 201, methyl beta naphthyl ketone, methyl cedrylone, methyl nonyl acetaldehyde, methyl dihydro jasmonate, methyl salicylate, moskene, musk xylol, myrcenyl acetate crude, nerol, nonalactone, oakmoss 25%, octyl aldehyde, olibanum resinoid 80%, opoponax oleo resin 70%, orange oil cold pressed, orange phase oil, orange terpenes, para hydroxy phenyl butanone, para tertiary buninal, patchouli, peppermint RP, peru balsam, petitgrain, phenyl ethyl alcohol, pine oil steam distilled, rose otto synthetic, rosemary, spearmint natural, spruce, terpineol, terpinolene, terpinolene, 4-tertiary butyl cyclohexyl acetate, tetra butyl cyclohexyl acetate, tetra hydro linalool, tonalid, thyme white oil, trichloromethyl phenyl carbinyl acetate, vanillin, vertivert, vertivert acetate, ylang ylang and others.

In an embodiment, the fragrance is Belmay Lemon or Belmay Citrus. Belmay Lemon or Belmay Citrus provides a pleasant fragrance to the compositions and is commercially available. Compositions containing from about 0% to about 20.0 weight % Belmay Lemon or Belmay Citrus are useful in compositions for removing adherent deposits from surfaces and substrates.

(f) Thickeners

A thickener is optionally added to the composition when the formulation is to be used on a surface or substrate which is so steep that a less viscous product would flow off of the substrate to quickly, such as from a wall or a vertical sign.

Cellulose and fumed silica make excellent thickeners for these compositions. For example, METHOCEL® J12-MS (cellulose ethers), commercially available from Dow Chemical Co., is a water-soluble polymer derived from cellulose. This natural polymer is often used to thicken water based formulations, for example water based paints and cleaners. Many different grades of cellulose are commercially available (pure to technical grades) and are used depending upon their application. Fumed silica (a form of silicon dioxide) can be used either as a hydrophilic or a hydrophobic thickener and are used in many liquid systems for their viscosity control, anti-sag and anti-settling behavior. In non-polar to semi-polar systems, hydrophilic AEROSIL® 130, 200, 300, 380 (hydrophilic fumed silica with a specific surface area of 130, 200, 300 and 380 $m^2/g$, respectively) grades are used whereas in semi-polar to polar systems, hydrophobic AEROSIL® R972 and R974 (hydrophobic fumed silica treated with DDS (dimethyldichlorosilane) with a specific surface area of 130 and 200 $m^2/g$, respectively), AEROSIL® R812S (hydrophobic fumed silica aftertreated with HMDS based on AEROSIL® 300), AEROSIL® R202 (hydrophobic fumed silica aftertreated with polydimethylsiloxane) and AEROSIL® R805 (fumed silica aftertreated with octylsilane based on AEROSIL® 200) are used.

In an embodiment, AEROSIL® 130 (hydrophilic fumed silica with a specific surface area of 130 $m^2/g$) is used as a thickener. In other embodiments, AEROSIL® 200, 300, 380 (hydrophilic fumed silica with a specific surface area of 130, 200, 300 and 380 $m^2/g$, respectively), R972, R974 (hydrophobic fumed silica treated with DDS (dimethyldichlorosilane) with a specific surface area of 130 and 200 $m^2$ $\mu$g, respectively), R812S (hydrophobic fumed silica aftertreated with HMDS based on AEROSIL® 300), R202 (hydrophobic fumed silica aftertreated with polydimethylsiloxane) or R805 (fumed silica aftertreated with octylsilane based on AEROSIL® 200) are used as thickeners. These thickeners are commercially available from Degussa-Huls. Compositions containing from about 0% to about 20.0 weight % AEROSIL® 130 (hydrophilic fumed silica with a specific surface area of 130 $m^2$ $\mu$g)) are useful for removing adherent deposits from surfaces and substrates.

It should be noted that the component first solvents, carrier solvents and various additives can be combined in any order, to afford the desired compositions. For convenience, however, the first solvent and any of the above listed additives, are usually added to the carrier solvent.

C. VOCs and Regulations

VOCs are defined in the federal rules (40 CFR Parts 9, 59 and 51, subpart F) as any compound of carbon, excluding carbon monoxide, carbon dioxide, carbonic acid, metallic carbides or carbonates, and ammonium carbonate, which participates in atmospheric photochemical reactions.

Methane, a nonreactive compound, is not a VOC, nor are other organic chemicals with negligible photochemical reactivity. Ground level ozone (smog), formed by a chemical reaction between VOCs and oxides of nitrogen ($NO_x$) in the presence of sunlight, presents serious air quality problems.

VOCs are emitted from diverse sources, including automobiles, chemical manufacturing facilities, gasoline/oil storage and transfer facilities, drycleaners, paint shops and other commercial and residential sources that use solvents and paint. Various consumer products are now required by federal law to have a low VOC composition.

Affected consumer products include but are not limited to: air fresheners; automobile windshield washer fluids; bathroom and tile cleaners; bug & tar removers; carburetor and choke cleaners; carpet & upholstery cleaners; cooking sprays; dusting aids; engine degreasers; fabric protectants; floor polishes; furniture polishes/waxes; general purpose cleaners; general purpose degreasers; glass cleaners; hairsprays; hair mousses; hair styling gels; household adhesives; insecticides; laundry prewashes; laundry starch products; nail polish removers; oven cleaners; shaving creams; spot removers; underarm antiperspirants; underarm deodorants and others. These products can be formulated by any means known to those of ordinary skill in the art, including but not limited to: aerosols; non-aerosols; liquids; pump sprays; solids; gels and other forms.

Listed in Table 1, are the Air Quality Management District (AQMD) and Environmental Protection Agency's (EPA) VOC limits for consumer products such as bug and tar removers, engine degreasers, general purpose cleaners, general purpose degreasers, laundry prewashes, spot removers and others. The maximal amounts of VOCs allowed in these products are calculated by a weight % basis and varies with the product's application and formulation's.

Low VOC compositions are those compositions, as used herein for consumer products, which contain less than or equal to the limits for VOCs as defined for the applications and formulations in Table 1.

TABLE 1

Air Quality Management District (AQMD) and Environmental Protection Agency's (EPA) VOC (Volatile Organic Compound) Limits

| Product Category | VOC Content Limit (Max weight % VOC) |
|---|---|
| Bug & Tar Remover | 40 |
| Carpet & Upholstery Cleaner | |
| Aerosol | 7 |
| Non-Aerosol | 3 |
| Engine Degreasers | |
| Aerosol | 50 |
| Non-Aerosol | 35 |
| General Purpose Cleaners | 10 |
| Non-Aerosols | 4 |
| General Purpose Degreasors | |
| Aerosol | 50 |
| Non-Aerosol | 4 |
| Laundry Prewash | |
| Aerosol | 22 |
| Non-Aerosol | 5 |
| Spot Remover | |
| Aerosol | 25 |

The compositions provided herein are low VOC compositions. The total amount of VOCs present (maximum weight % VOC) in these compositions meet the standards forth by the federal government for use in the above consumer good applications.

In certain embodiments, the compositions provided herein contain less than or equal to 50% VOCs. Other compositions contain less than or equal to 40% VOCs. In others, less than or equal to 35% VOCs. In others, less than or equal to 25% VOCs. In others, less than or equal to 22% VOCs. In others, less than or equal to 10% VOCs. In others, less than or equal to 7% VOCs. In others, less than or equal to 5% VOCs. In others, less than or equal to 4% VOCs. In others, less than or equal to 3% VOCs.

D. Evaluation of the Ability of the Compositions to Remove Adherent Deposits from Surfaces and Substrates The compositions provided herein can be and have been tested for their ability to remove adherent deposits from surfaces and substrates by the following procedure:

1. Remove any loose materials and blot up any excess liquid with a clean white cloth or towel.
2. Apply the compositions liberally, wait up to a minute and blot with a clean white cloth or towel.
3. Physically remove the released adherent particles from the surface or substrate by wiping with a clean cloth or towel.
4. For stubborn deposits, reapply the compositions, agitate the a 15 surface or substrate with a brush and remove the released deposits by either wiping with a clean white cloth or towel, scraping with a plastic spatula or scraper, or directing a stream of water against the surface or substrate.
5. For complex stains (complex adherent deposits) like mayonnaise or lipstick, apply a combination of the compositions provided herein and a cleaner designed for either water and protein based stains, or pen, ink and dye based stains, respectively.

It should be noted that the compositions provided herein can be used in combination with any of the many known cleaners, soaps, detergents, surfactants and other consumer cleaning products to remove complex stains (complex adherent deposits) from surfaces and substrates.

As is shown in the Examples, compositions A–P were tested for their ability to remove adherent deposits such as gum, crayon, markers and stickers from various surfaces and substrates such as polystyrene plastic, STYROFOAM® (polystyrene plastic), carpet and wallpaper. Compositions A to P were judged to be good at removing all of these deposits from these surfaces and substrates.

E. Methods of use

The methods of the present application are directed toward the release of adherent deposits from surface and substrates. Adherent deposits are characterized by the formation of an adherent layer that is attached to a surface or substrate. It is the purpose of these methods to eliminate, or at least to reduce the extent of attachment, so the adherent layer can be physically removed from the surface or substrate.

The previously described compositions have a multitude of uses on a variety of different surfaces and substrates. These uses include but are not limited to: automobile windshield washer fluid, bathroom and tile cleaners, bug & tar remover, carpet & upholstery cleaner, engine degreasers, carburetor and choke cleaners, floor polishes, general purpose cleaners, general purpose degreasers, glass cleaners, laundry prewash, nail polish removers, oven cleaners, spot removers and others.

Surfaces and substrates include both porous (soft) and non-porous (hard) materials. Examples of porous (soft) surfaces and substrates include but are not limited to: carpets, clothing, fabrics, tablecloths, napkins, automobile seats, athletic shoes, leather, suede and vinyl. Examples of non-porous (hard) surfaces and substrates include but are not limited to: concrete, cinderblock, cement, slumpstone, mountain rocks, split rocks, stucco, formica, glass, metals, iron work, steel, stainless steel, metal signs, street signs and freeway signs coated with a reflective screen, aluminum, metal alloys, auto parts, printing presses, brick-glazed and unglazed, vinyl, wood, wood floors, trees, plastics, plexiglass, fiberglass, linoleum, tile-glazed and unglazed, wallpaper, painted surfaces, blackboards and dry mark boards.

In practice, a composition is applied to a surface or substrate that has adhesive deposits. The composition may be applied either as a liquid solution, such as: a spray, a non-aerosol, an aerosol; or as a solid, such as: a gel, cream, paste, or an ointment. An appropriate amount of time is allowed for the composition to "soak" the adherent deposit, typically less than a minute. A release of the deposit from its surface or substrate is then observed. The released deposits are removed from the surface or substrate by a physical means such as a wiping, brushing, scraping, flushing or a rinsing with a stream of water. For convenience, the released deposits can be removed by a plastic spatula or scraper without concern about scratching or otherwise harming the surface or substrate. For difficult deposits, repeated applications of the composition and use of a high pressure water source may be necessary.

It should be noted that polystyrene plastics, including PLEXIGLAS® (acrylic plastic sheet) and polystyrene, are not fogged or dissolved by the compositions disclosed herein. Therefore, the use of these compositions for cleaning polystyrene surfaces is recommended.

It has been found herein that virtually all adherent deposits can be divided into three distinct categories of spots and stains. These deposits can be classified as being either: 1. water and protein based, 2. petroleum and natural oil based, or 3. pen, ink, marker and dye based (including fingernail polish and correction fluid). Most commercially available cleaning products only remove one type of adherent deposit or are applicable to only a specific type of surface or substrate.

The compositions provided herein can be used alone or can be combined with other known products including but not limited to those disclosed in U.S. Pat. Nos. 4,306,989; 5,227,085; 5,250,211; 5,415,800; 5,484,487 all incorporated herein by reference in their entirety.

For example:

MOTSENBOCKER'S LIFT OFF® #1 (food, beverage, protein stain remover), is formulated to work on water or protein based stains such as: coffee, tea, juice, KOOL-AID®, blood, soda, pet stains, grass and red wine, on surfaces and substrates such as: carpets, fabrics, clothes, tile, furniture, vinyl, cars, and wall coverings;

MOTSENBOCKER'S LIFT OFF® #2 (adhesive, oily foods and grease stain remover), was made to remove petroleum and natural oil stains such as: lipstick, crayons, chewing gum, candle wax, tape, sap, price stickers, salad dressings, olive oil and tar, on surfaces and substrates such as: wallpaper, vinyl, hardwood floors, counters, carpet, tools and clothes;

MOTSENBOCKER'S LIFT OFF® #3 (pen, ink and marker and graffiti remover), was created to remove stains such as: pen, inks, marker, dyes, stamp pad, nail polish and correction fluid, on surfaces and substrates such as: clothes, vinyl, carpets, fabrics, formica, tile and wall coverings.

The compostions and methods described herein can be used in combination with paint removers including but not limited to:

MOTSENBOCKER'S LIFT OFF® #4 (spray paint graffiti remover) and #5 (latex base paint remover) and others;

MOTSENBOCKER'S LIFT OFF® #4 (spray paint graffiti remover) is designed to remove stains such as: aerosol paint, emanel, semi-gloss, oil lacquers, high gloss, acrylic, primers, urethane enamels, sealer and stains, on surfaces and substrates such as: road signs, brick, PLEXIGLAS® (acrylic plastic sheet) and vinyl;

MOTSENBOCKER'S LIFT OFF® #5 (latex base paint remover) is designed to remove stains such as: latex low, semi-gloss and high gloss paints, latex spray paint, latex stains, wood stains, latex base sealer, paint over spray, on surfaces and substrates such as: carpet, furniture, clothes, concrete and tile.

Thus, the above MOTSENBOCKER'S LIFT OFF® #1–5 (removers) are stain specific. That is, they are specifically formulated to remove the specific types of stains indicated above. Similarly, the compositions provided herein are stain specific, and are formulated to remove the specific types of stains disclosed herein.

The compositions described herein are useful for releasing adherent deposits from surfaces and substrates including but not limited to: oils, greases, fresh paints (acrylics, enamel, latex, oil and primers), fresh lacquers, fresh shellacs, fresh wood stains, fresh varnishes, fresh urethanes, nail polishes, inks, permanent markers, newsprint, correction fluid, markers, foods, crayons, gums, stickers, adhesives, tapes, wallpaper adhesives and others.

The compositions disclosed herein can be used in combination with any commercially available or homemade cleaning products, to release adherent deposits composed of complex stains (complex adherent deposits). For example, mayonnaise, lipstick and crayons leave complex stains (complex adherent deposits) because they are contain mixtures of different classes of chemicals. Mayonnaise is composed of water, protein and natural oils (vinegar, egg yolks and olive oil). Optimal cleaning performance is achieved by combination of the compositions disclosed herein and a cleaner designed to dissolve water and protein stains, such as MOTSENBOCKER'S LIFT OFF® #1 (food, beverage, protein stain remover) and others. Lipstick and crayons are composed of paraffin and various dyes. Optimal cleaning performace is achieved by applying a combination of the compositions disclosed herein and a cleaner designed to dissolve inks and dyes such as MOTSENBOCKER'S LIFT OFF® #3 (pen, ink and marker and graffiti remover) and others. Thus, the compositions and methods disclosed herein can be used alone or in combination with other stain and spot removers, in particular MOTSENBOCKER'S LIFT OFF® #1 (food, beverage, protein stain remover) or #3 (pen, ink and marker and graffiti remover), to release many different and difficult adherent deposits from various surfaces and substrates.

Methods of releasing adherent deposits from a surface or substrate are provided herein, involving the steps of:

(a) applying a first low volatile organic compound (VOC) composition to the deposits;

(b) removing a portion of the deposits from the surface or substrate;

(c) applying a second composition to the deposits; and (d) removing the remaining portion of the deposits from the surface or substrate;

wherein the steps are performed in either of the following orders:

(a), then (b), then (c), and then (d); or (c), then (b), then (a), and then (d).

In particular, the first low VOC compositions for use in these methods are those provided herein. Second compositions for use in these methods include MOTSENBOCKER'S LIFT OFF® #1 (food, beverage, protein stain remover) or #3 (pen, ink and marker and graffiti remover).

Many stain and spot removers are substrate specific. For example, there are many products that are formulated to remove stains from specific items such as: automotive windshield washer fluid; bathroom and tile cleaners, engine degreasers, carburetor and choke cleaners, glass cleaners, carpet cleaners, laundry prewash, nail polish removers and others. The compositions described herein are useful for removing adherent deposits (spots and stains) from any surface or substrate. The compositions and methods are applicable to both porous (soft) and non-porous (hard) surfaces and substrates.

A major class of spot and stain removers use d-limonene as their active cleaning agent. D-limonene is the major component of the oil extracted from citrus rinds and has been used in paint solids, as a secondary cooling fluid, as an orange fragrance and in various cleaning products. Other spot and stain removers use a combination of d-limonene and kerosene (or other petroleum distillates) as the carrier solvent. The use of d-limonene in consumer products is limited because it is considered to be a VOC.

Many stain and spot removers use kerosene and other petroleum distillates as the carrier solvent. After evaporation, spot and stain removers which use petroleum distillate solvents tend to leave a greasy residue in fabrics which may either cause decolorization or act to attract dirt. Light Hydrotreated Petroleum Distillates acts like any other petroleum distillate when it is used to treat a fabric: the evaporation process leaves a greasy residue which can either decolorize or attract dirt. However, when Light Hydrotreated Petroleum Distillates is used in combination with an acetal, ketal or ortho ester, the composition dries without leaving a greasy residue or decolorizing the fabric. Methylal is a particularly useful acetal, not only for its stain and spot removing properties but also for its ability to pull the carrier solvent out of a fabric.

Stains, spots and other adherent deposits can generally be released from a surface or substrate by treatment with hot water (>180° C.) or steam. Further, restaurants use white table clothes not only for their inherent aesthetic value but because spots and stains are easier to mask by a bleaching process than they are to remove. These harsh conditions are not generally applicable to most surfaces and substrates. The compositions and methods disclosed herein can be used at ambient temperature and because the adherent deposits are removed from the surface or substrate, bleaching is not required.

It should be noted that the lists provided are not intended to be exhaustive, but instead to be illustrative of the wide range of utility of the described compositions and methods.

The following examples are included for illustrative purposes only and are not intended to limit the scope of the invention.

EXAMPLES A to H

| Reagent | A* | B* | C* | D* | E* | F* | G* | H* |
|---|---|---|---|---|---|---|---|---|
| Calumet 400–500 | 89.0 | 87.0 | 91.0 | 89.0 | 92.0 | 85.0 | 83.0 | 84.0 |
| Methylal | 2.0 | 2.0 | 0 | 0 | 6.2 | 6.2 | 6.2 | 2.0 |
| Ethanol | 0 | 0 | 0 | 0 | 0.8 | 0.8 | 0.8 | 0 |
| Belmay Citrus | 1.0 | 1.0 | 1.0 | 1.0 | 1.0 | 1.0 | 1.0 | 1.0 |
| TRITON ® X-100 | 0 | 2.0 | 0 | 2.0 | 0 | 0 | 2.0 | 5.0 |
| Water | 0 | 0 | 0 | 0 | 0 | 0 | 0 | 0 |
| BUTYL CELLO-SOLVE ® | 0 | 0 | 0 | 0 | 0 | 0 | 0 | 0 |
| n-Propyl Bromide | 8.0 | 8.0 | 8.0 | 8.0 | 0 | 7.0 | 7.0 | 8.0 |

EXAMPLES I TO P

| Reagent | I* | J* | K* | L* | M* | N* | O* | P* |
|---|---|---|---|---|---|---|---|---|
| Calumet 400–500 | 91.0 | 95.7 | 91.0 | 84.0 | 30.0 | 0 | 0 | 0 |
| Methylal | 0 | 3.0 | 6.2 | 10.0 | 10.0 | 19.0 | 11.9 | 12.4 |
| Ethanol | 0 | 0.3 | 0.8 | 5.0 | 10.0 | 1.9 | 1.2 | 1.2 |
| Belmay Citrus | 1.0 | 1.0 | 1.0 | 1.0 | 1.0 | 1.0 | 1.0 | 1.0 |
| TRITON ® X-100 | 5.0 | 0 | 1.0 | 0 | 10.0 | 2.9 | 2.7 | 12.4 |
| Water | 0 | 0 | 0 | 0 | 29.0 | 75.2 | 71.3 | 60.7 |
| BUTYL CELLO-SOLVE ® | 0 | 0 | 0 | 0 | 10.0 | 0 | 11.9 | 12.4 |
| n-Propyl Bromide | 3.0 | 0 | 8.0 | 8.0 | 0 | 0 | 0 | 0 |

*Values are given as weight %.

Compositions A to P show a range of possible combinations of first solvents, carrier solvents and additives that are useful for the release of adherent deposits from surfaces and substrates. Compositions A to L are based on the use of Calumet 400-500, also known as Light Hydrotreated Petroleum Distillates, as the carrier solvent whereas compositions N—H use water. Example M contains a mixture of petroleum and water as the carrier solvents. To these carrier solvents, additives such as ethanol, Belmay Lemon or Belmay Citrus, TRITON® X-100 (polyoxyethylene (10) isooctylphenyl ether), BUTYL CELLOSOLVE® (2-butoxyethanol) and n-propyl bromide are optionally added for optimal adherent deposit removal performance and consumer appeal. These compositions can or have been tested for their ability to remove adherent deposits from surfaces and substrates. All compositions tested were found to be effective at removing adherent deposits.

Compositions that are particularly useful for releasing adherent deposits from surfaces and substrates include Examples E, H and 0.

In Example E, the first solvent is 6.2% methylal, the carrier solvent is 92.0% Light Hydrotreated Petroleum Distillates, the cleaner is 0.8% ethanol and the fragrance is 1.0% Belmay Citrus.

In Example H, the first solvent is 2.0% methylal, the carrier solvent is 84.0% Light Hydrotreated Petroleum Distillates, the second solvent is 8.0% n-propyl bromide, the surfactant is 5.0% TRITON® X-100 (polyoxy-ethylene (10) isooctylphenyl ether) and the fragrance is 1.0% Belmay Citrus.

In Example O, the first solvent is 11.9% methylal, the carrier solvent is 71.3% water, the cleaner is 0.8% ethanol, the surfactant is 2.7% TRITON® X-100 (polyoxyethylene (10) isooctylphenyl ether), the coupling agent is 11.9% BUTYL CELLOSOLVE® (2-butoxyethanol) and the fragrance is 1.0% Belmay Citrus.

Since modifications will be apparent to those of skill in this art, it is intended that this invention be limited only by the scope of the appended claims.

What is claimed is:

1. A composition for releasing an adherent from a fabric comprising:

a) 6.2% by weight methylal, b) 92% by weight light hydrotreated petroleum distillate, c) 0.8% by weight ethanol, and d) 1% by weight citrus fragrance, said composition possessing less than 3% VOC content and said composition when dried on the fabric results in no greasy residue left behind on the fabric.

2. A composition for releasing an adherent from a fabric comprising:

a) 3% by weight methylal, b) 95.7% by weight light hydrotreated petroleum distillate, c) 0.3% by weight ethanol, and d) 1% by weight citrus fragrance, said composition possessing less than 3% VOC content and said composition when dried on the fabric results in no greasy residue left behind on the fabric.

* * * * *